United States Patent [19]

Kubota et al.

[11] Patent Number: 4,775,565

[45] Date of Patent: Oct. 4, 1988

[54] VESSEL FOR REFRACTORY USE HAVING MULTI-LAYERED WALL

[75] Inventors: Yoshihiro Kubota; Isao Yanagisawa; Ryoji Iwai, all of Gunma, Japan

[73] Assignee: Shin-Etsu Chemical Co., Ltd., Tokyo, Japan

[21] Appl. No.: 885,880

[22] Filed: Jul. 15, 1986

[51] Int. Cl.[4] ..... F27B 14/10

[52] U.S. Cl. ..... 428/35; 428/218; 432/264; 432/265

[58] Field of Search ..... 428/218, 35; 432/264, 432/265

[56] References Cited

U.S. PATENT DOCUMENTS

| | | | |
|---|---|---|---|
| 3,491,992 | 1/1970 | Reichelt | 432/265 |
| 3,724,996 | 4/1973 | Montgomery | 432/265 |
| 3,911,188 | 10/1975 | Torti et al. | 428/218 |
| 3,931,438 | 1/1976 | Beall et al. | 428/218 |
| 4,492,765 | 1/1985 | Buljan | 428/218 |
| 4,552,800 | 11/1985 | Blasch et al. | 428/218 |

*Primary Examiner*—John E. Kittle
*Assistant Examiner*—James J. Seidleck
*Attorney, Agent, or Firm*—Jules E. Goldberg

[57] ABSTRACT

The inventive vessel, e.g. crucible, made of a refractory inorganic material such as boron nitride has a multi-layered wall structure which is an integral alternate lamination of layers of higher density and layers of lower density. Such a multi-layered structure can be formed by the procedure of pyrolytic chemical vapor deposition in the course of which the concentration of the gaseous reactants, e.g. boron trichloride and ammonia, in the atmosphere is changed, i.e. increased or decreased, under control so that the resultant deposited boron nitride layer has different densities in the portions deposited before and after the concentration change. By virtue of the multi-layered wall structure, the vessel has outstandingly improved resistance against thermal shock and can withstand prolonged use or many times of repeated use at high temperatures without breaking or crack formation.

2 Claims, No Drawings

VESSEL FOR REFRACTORY USE HAVING MULTI-LAYERED WALL

BACKGROUND OF INVENTION

The present invention relates to a vessel for refractory use or, more particularly, to a refractory vessel such as a crucible, boat, tube and the like capable of prolongedly withstanding extremely high temperatures frequently encountered in various processing procedures.

As is well known, progress of technologies in recent years results in a great increase of the kinds of processing procedures performed under extremely high temperatures. For example, various kinds of highly refractory materials, such as metals, metal compounds, glasses, ceramics and the like, are sometimes melted at the respective high melting points for the purpose of fabrication. The manufacturing process of semiconductor devices sometimes include a step in which certain materials such as gallium, arsenic, indium, aluminum and the like are melted in boat and vaporized. Further, many of single crystal materials used in electronic technologies, such as the so-called III-V compound semiconductors, e.g. gallium arsenide, gallium phosphide and indium phosphide, are manufactured by the Czochralski method for single crystal growing in whcih the starting materials are melted in a crucible.

Needless to say, one of the important factors having influences on the costs of these high-temperature processes is the durability or serviceable life of the vessel, e.g. crucibles, boats, tubes and the like, used in the process. Namely, it is usual that the vessel is used repeatedly in several runs until the vessel is broken or destroyed by the thermal stress. None of the conventional vessels are satisfactory in this regard since they are sometimes prematurely destroyed by the thermal shock in cooling or repeated heating cycles between room temperature and the high processing temperature. Often, they break after a continued use for a relatively short length of time or repeated use only in a few runs of an unpredictable number. Accordingly, it has been eagerly desired to have such refractory vessels capable of withstanding a prolonged use or a large number of repeated runs of use.

SUMMARY OF THE INVENTION

Therefore, an object of the present invention is to provide a vessel for refractory use capable of being used prolongedly in a continued service or in a large number of repeated runs at high temperatures.

The invention has been completed as a result of the extensive investigations in the direction to give relaxation or moderation of the stress in the walls of the vessel caused by the difference in the thermal expansion coefficients between the material of the vessel and the material contained therein. Thus, the refractory vessel of the invention has a wall having a layered structure of at least two integral layers of chemically the same material, in which a first layer has a texture of a substantially higher density than the density of a second layer. When the wall of the vessel is formed of more than two layers, the wall should have a multi-layered structure in which layers having a higher density and layers having a lower density are integrated alternately.

DETAILED DESCRIPTION OF THE PREFERRED EMBODIMENTS

The material of the inventive refractory vessel is an inorganic material and should be selected according to the particular use of the refractory vessel. When the vessel is used in melting of a metal, metal compound, glass, ceramic and the like, for example, it is a desirable condition that the wall of the vessel is little wettable by the melt contained therein or is insusceptible to the corrosive attack of the melt. Exemplary of the refractory material for the inventive vessel are nitrides such as boron nitride, aluminum nitride, titanium nitride and the like, carbides such as silicon carbide, boron carbide and the like, borides such as zirconium boride, titanium boride and the like and oxides suh as silicon dioxide, aluminum oxide and the like.

It is a convenient way to use the method of vapor deposition for forming the multi-layered walls of the inventive refractory vessel composed of integrated high-density and low-density layers while the density of the deposited layers is controllable by suitably selecting the conditions of vapor deposition. Namely, a substrate body to serve as a core is heated at a temperature of 1000° to 2000° C. and the above mentioned inorganic material, i.e. nitride, carbide, boride or oxide, is vaporized and deposited on the surface of the substrate body according to a known technique of pyrolytic chemical vapor deposition, plasma-induced vapor deposition, sputtering, physical vapor deposition and the like followed by cooling in an inert atmosphere and removal of the substrate body from the form of the vessel deposited thereon. The control of the conditions in the course of the vapor deposition provides a means of forming layers having different densities.

Such a multi-layered structure of the vessel walls is advantageous in respect of relaxing or moderating the thermal stress caused by heating or cooling which otherwise may result in destruction of the vessel subjected to a thermal shock or used in repeated cycles of heating and cooling.

When a vessel, e.g. crucible or boat, for use in the manufacturing or processing of semiconductors or related materials is desired, it is essential that the material of the vessel is of a high purity and the walls should have a considerably large thickness to ensure sufficient mechanical strengths as is the case in the crucibles for evaporating an element such as gallium, arsenic and aluminum for the procedure of molecular beam epitaxy (MBE) and for Czochralski single crystal growing of the III–V compound semiconductors, e.g. indium phosphide and gallium phosphide. In this regard, a preferable material to form the inventive vessel is boron nitride obtained by the pyrolytic chemical vapor deposition involving the pyrolytic decomposition reaction of boron trichloride and ammonia or diborane and ammonia.

When the pressure or the concentration of the reactant gases in the atmosphere is changed in the pyrolytic chemical vapor deposition, the resultant layers of, for example, boron nitride have different densities before and after the pressure change. For example, a layer of a higher density is deposited when the reaction pressure is decreased while the density of the deposited layer may have a lower density by increasing the reaction pressure. Such a change in the reaction pressure can be effected as many times as desired so that the deposited layer as a whole may have a number of layers having different densities corresponding to the number of the pressure change. The number of the layers, however, should be minimized to a number capable of giving satisfactory heat resistance to the vessel for the particular intended use of the vessel and the desired durability in consideration of the balance with increase in the costs when the number of layers is increased more than necessary although the heat resistance of the refractory vessel may be further increased correspondingly.

The thickness of each layer is not particularly limitative but it is preferably in the range from 0.1 to 5.0 mm. The thickness can be controlled by suitably selecting the length of time for the vapor deposition and the concentration of the reactants in the gaseous atmosphere. The density of each layer of course depends on the type of the deposited material. When the deposited material is boron nitride, the density is in the range from 1.0 to 2.3 g/cm$^3$. The difference in the density between the high-density layer and the low-density layer should be controlled to be in the range from 0.3 to 1.3 g/cm$^3$ in consideration of the balance between the resistance against thermal shock and mechanical strengths.

In the following, the vessel for refractory use according to the invention is described in more detail by way of examples.

EXAMPLE 1

A cylindrical graphite block having a diameter of 20 mm and a height of 50 mm was heated and kept at 2000 ° C. in a reaction furnace into which gases of boron trichloride and ammonia were introduced at rates of 0.2 liter/minute and 0.4 liter/minute, respectively, to effect pyrolytic chemical vapor deposition of boron nitride on the surface of the graphite block. The pressure inside the furnace was controlled by the adjustment of the rate of evacuation by a vacuum pump and kept at 1.0 mmHg for the first 10 hours and then at 100 mmHg for the next 10 hours. After the end of the above mentioned reaction time, the reaction furnace was cooled by introducing nitrogen gas and the graphite block bearing the crust of bornn nitride layer was taken out of the furnace. The thus formed boron nitride body in a crucible-like form of 21 mm inner diameter and 50 mm depth was freed from the graphite core and examined for the cross sectional structure to find that the boron nitride crucible had a double-layered wall, of which the inner layer had a thickness of 1.2 mm and a density of 2.0 g/cm$^3$ while the outer layer had a thickness of 1.6 mm and a density of 1.8 g/cm$^3$.

This double-layered boron nitride crucible was used as a vessel for molecular beam epitaxy at 1100 ° C. repeatedly to find that the crucible could withstand 20 times of repeated runs without breaking or crack formation.

For comparison, the same procedure of molecular beam epitaxy under the same conditions as above was repeated using a conventional boron nirride crucible having the same inner dimensions as above with a wall thickness of 2.8 mm and a uniform density of 2.0 g/cm$^3$. The result was that the crucible was broken after only three times of repeated runs.

EXAMPLE 2

A boron nitride crucible having an inner diameter of 4 inches and depth of 100 mm was prepared in substantially the same manner as in Example 1 except that the reaction pressure was changed three times during the chemical vapor deposition so that the wall had a quadruple-layered structure composed of the innermost layer and the third layer each having a thickness of 0.7 mm and a density of 2.0 g/cm$^3$ and the second and the outermost layer each having a thickness of 0.9 mm and a density of 1.6 g/cm$^3$.

This quadruple-layered boron nitride crucible was used as a vessel for the Czochralski single crystal growing of gallium arsenide repeatedly to find that the crucible could withstand 23 times of repeated runs without breaking.

For comparison, a conventional boron nitride crucible having the same dimensions as above was used in the same manner in the single crystal growing to find that cracks were found in the crucible already after only two times of repeated runs.

EXAMPLE 3

A double-walled aluminum nitride boat of 300 ml capacity was prepared in a similar manner to Example 1, of which the inner layer had a thickness of 2.3 mm and a density of 2.3 g/cm$^3$ while the outer layer had a thickness of 2.8 mm and a density of 1.2 g/cm$^3$ This aluminum nitride boat was used for the vaporization treatment of indium to find that the boat could withstand 15 times of repeated runs. A comparative test was undertaken by use of a conventional aluminum nitride boat of about the same dimensions as above having a wall thickness of 5.2 mm and a uniform density of 2.3 g/cm$^3$ to find that the boat was destroyed after only 7 times of repeated runs.

What is claimed is:

1. A refractory vessel prepared by depositing by pyrolytic vapor deposition, a layer of boron nitride on an inert form having the shape of the desired vessel at a given set of conditions to produce a desired thickness of deposit having a first density, and then changing the conditions at least once to form another deposit layer of boron nitride having a different density from the first layer, the differnce in densities being in the range from 0.3 to 1.3 g/cm$^3$.

2. A refractory vessel having a wall which is an integral lamination of at least two alternate layers of a first layer and a second layer each made of boron nitride having different densities from each other, the difference in densities between the first and second layers being in the range from 0.3 to 1.3 g/cm$^3$.

* * * * *